US006182663B1

(12) United States Patent
Madden

(10) Patent No.: US 6,182,663 B1
(45) Date of Patent: Feb. 6, 2001

(54) PATIENT POSITIONING APPARATUS AND METHOD FOR SPINAL TAP

(76) Inventor: Thomas C. Madden, 6195 Deerwood Dr., Greenwood, IN (US) 46143

( * ) Notice: Under 35 U.S.C. 154(b), the term of this patent shall be extended for 0 days.

(21) Appl. No.: 09/558,572

(22) Filed: Apr. 26, 2000

(51) Int. Cl.[7] ..... A61G 15/00
(52) U.S. Cl. ..... 128/845; 128/846
(58) Field of Search ..... 128/845, 846, 128/869, 870; 269/322, 328

(56) References Cited

U.S. PATENT DOCUMENTS

| | | | | |
|---|---|---|---|---|
| 3,984,093 | * | 10/1976 | Pretlow | 269/328 |
| 4,660,552 | * | 4/1987 | Latham | 128/834 |
| 4,732,145 | * | 3/1988 | Latham | 128/834 |
| 5,289,603 | * | 3/1994 | Kumagai | 5/624 |
| 5,357,982 | * | 10/1994 | Shaw | 128/845 |

* cited by examiner

*Primary Examiner*—Michael A. Brown
(74) *Attorney, Agent, or Firm*—Woodard, Emhardt, Naughton, Moriarty & McNett

(57) ABSTRACT

A footrest and an abdomen locator are supported on a post mounted on a base which rests on a floor. A patient is seated on the table of a medical cart, with feet on a footrest bar on a floor mounted positioning device. The cart table height is adjusted so that the patient's knees are higher than the pelvis, tipping the pelvis backward. A horizontally and vertically adjustable bar on the device is placed against the abdomen at about the height of the umbilicus, providing a stop about which the patient can curl the upper part of the body forward, reversing the normal lumbar curve, opening the space between vertebral bodies at the dorsal side, facilitating a spinal tap. Base support feet are provided for non-slip engagement with the floor during the procedure, and rollers are provided on the base and situated to facilitate tipping and rolling the base from one location to another after a procedure has been completed.

13 Claims, 3 Drawing Sheets

PATIENT POSITIONING APPARATUS AND METHOD FOR SPINAL TAP

BACKGROUND OF THE INVENTION

This invention relates generally patient support equipment for the healthcare field, and more particularly to a patient positioning apparatus and method for facilitating a spinal tap procedure.

The difficult aspect of performing a spinal tap, is avoiding the spinous processes which protect the spinal canal. Various devices have been invented and patented in the past to facilitate the performance of a spinal tap. Examples of which I am aware are found in U.S. Pat. Nos. 5,357,982; 5,289,603; 4,732,145; 4,660,552; 4,444,381; 4,223,670; 3,984,093; and 3,829,079. Many of these devices are arranged to provide patient positioning and restraint features to facilitate a spinal tap or surgical procedure on a patient lying on his or her side, and appear to be better suited to pediatric patients than to adult patients.

There is a need for apparatus facilitating the spinal tap procedure and wherein such apparatus is of simpler construction, easier for the physician to use, readily adaptable to positioning adult patients of various heights and builds, readily movable from place-to-place, and easy to store. The present invention addresses these needs.

SUMMARY OF THE INVENTION

Described briefly, according to a typical embodiment of the present invention, a footrest and an abdomen locator are supported on a post mounted on a base which rests on a floor. The base is associated with a medical cart on which the patient is seated. The height of the cart seat relative to the footrest is established so that the patient is seated with knees at a level preferably above the pelvis. The abdomen locator is positioned to facilitate the bending forward of the patient to flex the back to reverse the normal curvature of the lumbar spine as the footrest tilts the pelvis. The extension of the post above the level of the abdominal locator makes it easy for the patient to curl around the locator and reverse the lumbar curve. Base support feet are provided for non-slip engagement with the floor during the procedure, and rollers are provided on the base and situated to facilitate tipping and rolling the base from one location to another after a procedure has been completed.

DESCRIPTION OF THE ILLUSTRATED EMBODIMENT

Figure 1:
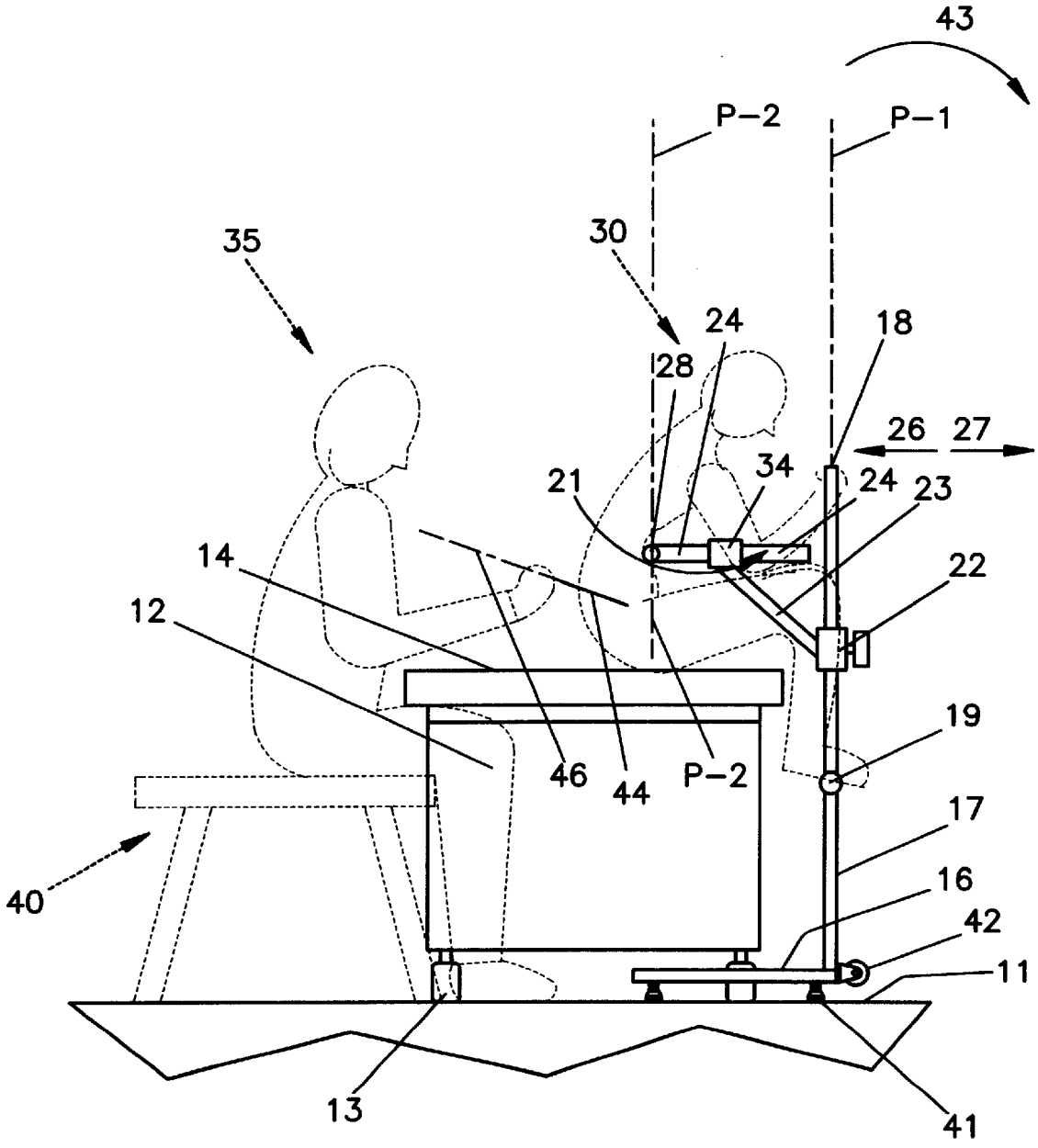
FIG. 1 is a side elevational view of apparatus according to a typical embodiment of the present invention in use with a patient (shown in phantom) sitting on a medical cart, and a physician (shown in phantom) sitting on a stool (shown in phantom) performing the procedure.
Figure 2:
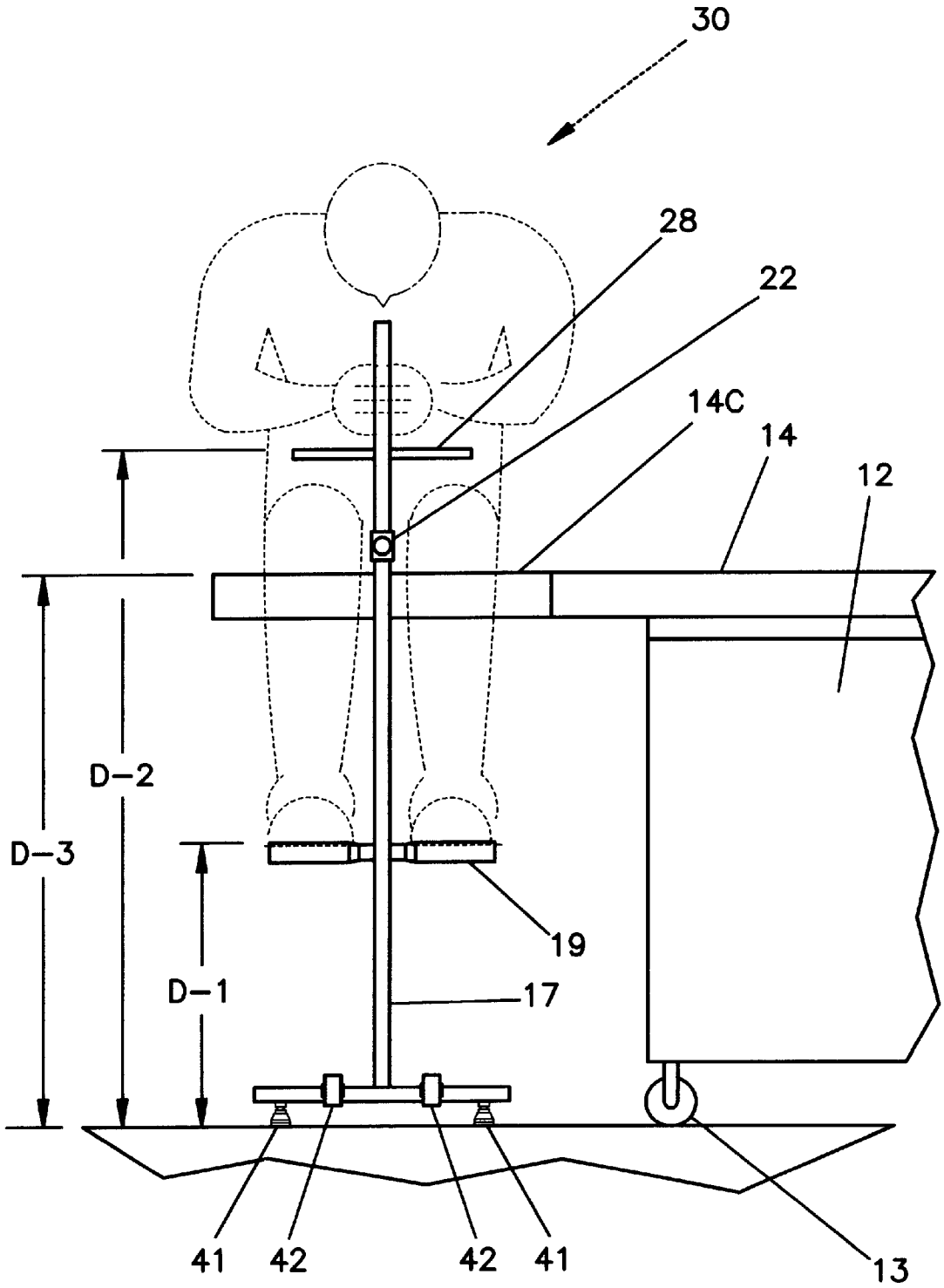
FIG. 2 is a front elevational view.
Figure 3:
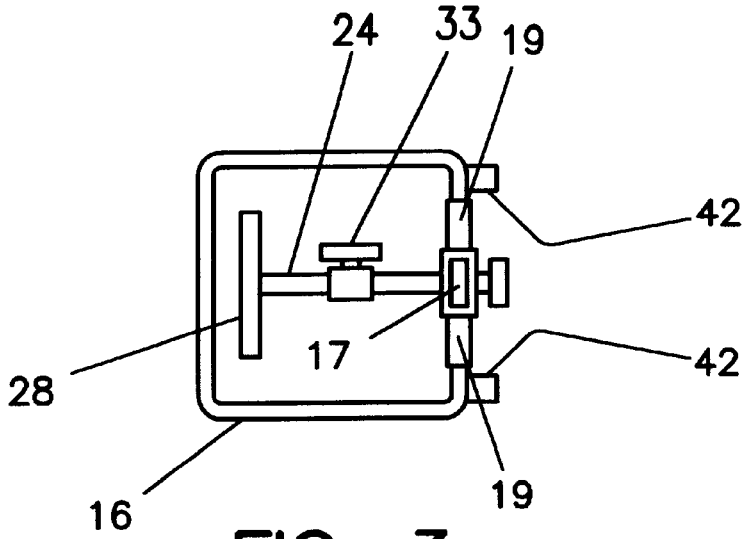
FIG. 3 is an enlarged top plan view of the apparatus.
Figure 4:
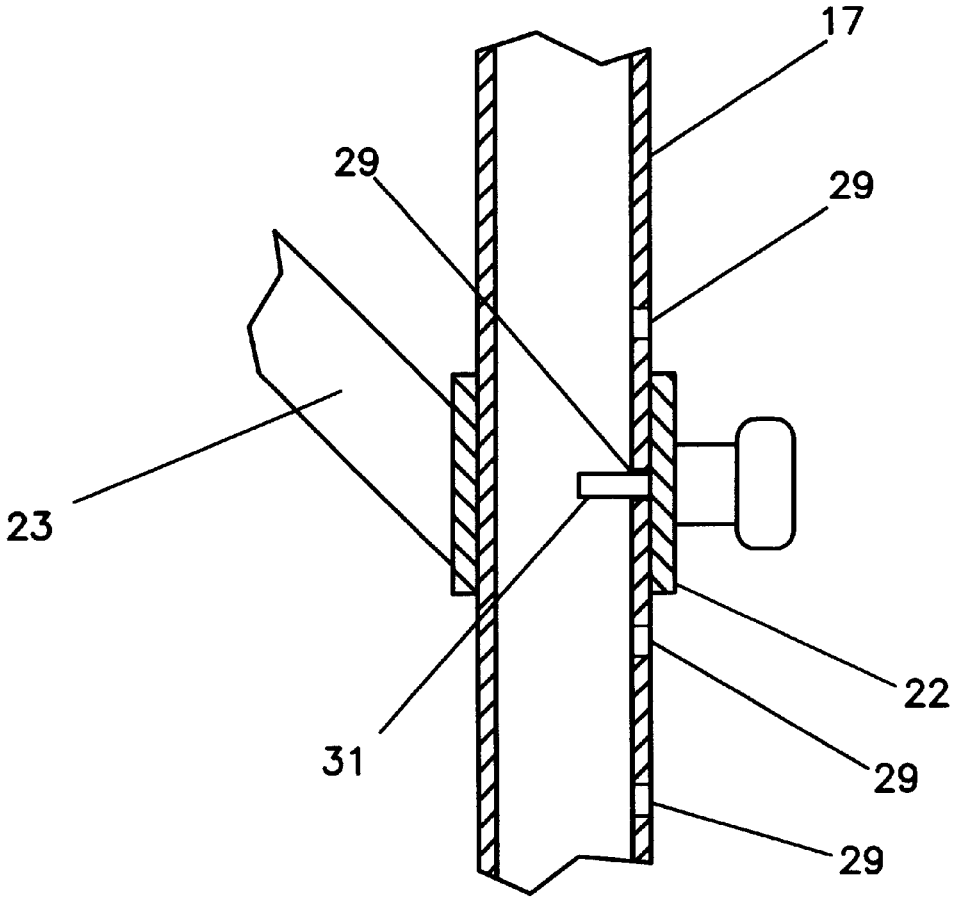
FIG. 4 is an enlarged fragmentary section view through the post where the arm support bracket is mounted to the post.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawings in detail, in FIG. 1 there is shown the floor 11 of the room or other site at which the procedure is to be performed. The conventional medical cart 12 is moved to the site on its caster wheels 13 which are typically provided with a brake system to avoid rolling or swiveling of the cart when in use. The top 14 of the cart is adjustable vertically in conventional manner so that it may be placed anywhere from 24 inches to 36 inches above the floor. It has a cantilever extension portion 14C which moves vertically with the top 14 when the top is raised or lowered. The extension may be a hinged fold-out, or a slide-out style. Of course, other seating devices with other arrangements may also be used in practicing the present invention.

The positioner itself includes a base 16 supporting an upstanding post 17 extending to the top 18. A footrest in the form of a bar 19 is mounted to the post 17 in a vertical plane P-1. An abdominal stop assembly 21 includes an adjustable bracket 22 supporting an arm holder 23 and adjustable arm 24 which is adjustable in and out in the direction of arrows 26 and 27, respectively, in the arm holder 23. A cross bar 28 is fixed to the distal end of adjustable arm 24 to serve as an abdominal locator or stop in a vertical plane P-2.

In the illustrated example, the footrest 19 is fixed to the post 17 at a first distance D-1, which may be approximately 12 inches above the floor 11, for example. The adjustable arm holder bracket 22 is a tube vertically slidable on the post 17 through a range from 21 inches through 27 inches above the floor. In an example, where four possible adjustment positions are available, four holes 29, vertically spaced two inches apart up the post, are available for reception of a spring-loaded, knob-operated detent pin 31 to secure the bracket 22 at any of the four possible vertical locations along the post 17. This provides for vertical adjustment of the abdominal locator bar 28 at a second distance D-2 above the floor. To provide for horizontal adjustment of the locator bar, toward or away from the patient 30 in the direction of arrows 26 or 27 respectively, a knob-operated set-screw 33 is threaded into a tubular collar 34 fixed to the distal end of the holder 23. The arm 24 can slide toward or away from the patient while the screw is loose, for adjustment purposes. Then, when the proper position of the arm is located for the horizontal bar 28 to be pressing against the abdomen of the patient, and provide the hyper-flexing curve as shown in FIG. 1 for the spine, the knob is turned and the screw tightened against the arm 24 to fix the bar 28 in the desired location. Then, with the patient curled around the bar 28 and holding onto the upper portion of the post extending above the bracket 22, the spine is thereby hyper-flexed so as to enable the physician 35 to conveniently and accurately perform the spinal tap procedure. This also enables the patient to be as comfortable as possible for such procedure.

It is understood that the height of the top of the medical cart, and thereby the cantilever top extension portion 14C, which serves as the seat for the patient in the illustrated example, can be adjusted to the height (distance D-3 above the floor) desired to accommodate the stature of the patient. Similarly, the height of the horizontal bar 28 with respect to the floor and, thereby, the seat, as well as the distance of the bar 28 from the post 17 can be adjusted to accommodate the contour of the patient in the abdominal area. This enables the physician to be sure that, with the patient sitting at a fixed position established between the post 17 and the pelvis, the patient can appropriately curl around the bar 28 to provide the necessary spinal curve for the spinal tap procedure. By seating the patient on the cantilever top extension portion, there is space under that portion for a stool 40 on which the physician can sit comfortably on the stool while performing the spinal tap procedure. Of course, the apparatus according to the present invention facilitates performing other procedures too.

In the illustrated example, the base 16 is made of a generally rectangular organization of square tubing. The base is approximately 12 inches square and supported on four feet 41 of non-skid material with embedded studs screwed into holes in the bottom of the base tubing for such leveling of the base as may be desired. Lock nuts on the studs are used for fixing the leveling feet in the adjusted heights. In addition, and to facilitate moving the device from site-to-site between procedures, two rollers 42 are mounted to the front of the base near the bottom. To move the device, it can be tilted forward about the front feet 41 in the direction of the arrow 43 (FIG. 1), and rolled along the floor.

In the use of the apparatus and according to the method, of the present invention, the patient is seated on the table top and the positioner is rolled into place or the table is rolled into place, depending upon the organization of the treatment site. Then the patient places his/her feet on the rest, with the table being raised or lowered for the comfort of the patient while providing at least some tilting of the pelvis with the patient's knees are above the table top level. Then the adjustment arm holder is raised or lowered on the post to locate the stop bar 28 at or about the level of the patient's umbilicus. Typically this is with the horizontal arm 24 retracted away from the patient in the direction of arrow 27. Then the arm 24 is moved toward the patient in the direction of arrow 26 to an extent sufficient that abdominal stop bar engages the abdomen, and the knob for set screw 33 is tightened, to fix the arm 24 in the holder. Then the patient can curl around the stop bar 28 so that the patient's head is forward of a vertical plane containing the contact of the pelvis with the table top, thus assuring sufficient hyperflexing of the spine to spread the vertebral bodies sufficiently at the back to facilitate the spinal tap. Then the physician, seated on the stool 40, introduces a needle 44 generally in the direction of arrow 27 along the line 46 to perform the tap. When the procedure is completed, the table or the positioning device can be separated or the arm 24 released first, according to whatever is most convenient for the patient to depart the site.

While the invention has been illustrated and described in detail in the drawings and foregoing description, the same is to be considered as illustrative and not restrictive in character, it being understood that only one embodiment has been shown and described and that all changes and modifications that come within the spirit of the invention are desired to be protected.

What is claimed is:

1. A method for positioning a patient for a spinal tap procedure and comprising the steps of:

seating a patient with the patient pelvis at one level;

placing the patient's feet at a first level below the one level; and placing and holding the patient's abdomen against an abdominal stop located behind an upstanding plane containing the footrest.

2. The method of claim 1 and further comprising the step of:

locating the patient's knees above the one level, to tilt the pelvis backward.

3. The method of claim 1 and further comprising the steps of:

placing the patient's shoulders ahead of an upstanding plane containing the abdominal stop.

4. A method for positioning a patient for a spinal tap procedure and comprising the steps of:

seating a patient with the patient's pelvis at one level;

placing the patient's feet at a level lower than the one level; and placing and holding the patient's abdomen against a stop located at a level above said one level.

5. The method of claim 4 and further comprising the step of:

placing the patient's shoulders ahead of an upstanding plane containing the abdominal stop.

6. The method of claim 4 and further comprising the steps of:

providing clear floor space under the patient's seating area;

placing a base portion of patient positioning apparatus on the floor in a portion of the space; and placing a seating device on the floor in the space for a health care provider to perform a procedure on the patient.

7. Positioning apparatus for spinal tap procedure and comprising:

a base;

a post mounted on said base;

a footrest mounted on said post at a first distance above said base; and an abdomen locator mounted on the post, said abdomen locator being positioned at a second distance greater than said first distance above said base, for engagement of the locator with a patient's abdomen and for enabling the patient to curl forward around the locator.

8. The apparatus of claim 7 and further comprising:

a seat associated with said base at a third distance above said base and which is greater than the first distance and less than the second distance.

9. The apparatus of claim 8 and wherein:

the seat and footrest are vertically adjustable relative to each other to change the difference between the first and third distances.

10. The apparatus of claim 7 and wherein:

the base has a front and a rear, the post being located adjacent the front, and the abdomen locator being located above the rear.

11. The apparatus of claim 7 and further comprising:

a locator arm holder slidable on said post for selectable movement to different levels on said post;

a locator arm slidable on said holder toward and away from said post, said abdomen locator being on said arm near a distal end of said arm.

12. The apparatus of claim 11 and wherein:

said locator arm holder includes a mounting bracket;

said post has a plurality of detent features therein; and said bracket has a detent feature engageable with selectable detent features of said plurality for positioning and retaining said bracket and thereby said locator arm at selectable levels above said base.

13. The apparatus of claim 12 and further comprising:

position locking means on said holder to fix said locator arm in position relative to said holder, but releasable to enable intentional movement of said abdomen locator toward and away from said post.

* * * * *

UNITED STATES PATENT AND TRADEMARK OFFICE

CERTIFICATE OF CORRECTION

PATENT NO. : 6,182,663 B1
DATED : February 6, 2001
INVENTOR(S) : Thomas C. Madden It is certified that error appears in the above-identified patent and that said Letters Patent is hereby corrected as shown below:

Title Page,
Item [56], References Cited, U.S. PATENT DOCUMENTS, please add:

| | | | | |
|---|---|---|---|---|
| -- | 3,829,079 | 8/1974 | Fox ……... 269/328 | |
| | 4,223,670 | 9/1980 | Cramer ……. 128/134 | |
| | 4,398,707 | 8/1983 | Cloward …… 269/328 | |
| | 4,444,381 | 4/1984 | Wayne …….. 269/328 | |
| | 4,534,341 | 8/1985 | Bart et al ……... 128/75 | |
| | D-243,285 | 2/1977 | Langren ……. D83/1D | --. |

Signed and Sealed this

Twenty-fifth Day of June, 2002

*Attest:*

*Attesting Officer*

JAMES E. ROGAN
*Director of the United States Patent and Trademark Office*